United States Patent [19]

Dufford, Jr. et al.

[11] 4,217,491

[45] Aug. 12, 1980

[54] COUNTING SYSTEM FOR ARTICLES CONVEYED IN A STREAM

[75] Inventors: Max H. Dufford, Jr., Lakewood, Colo.; Earl T. Price, San Jose, Calif.

[73] Assignee: Nolan Systems Inc., Denver, Colo.

[21] Appl. No.: 920,548

[22] Filed: Jun. 29, 1978

[51] Int. Cl.[2] ..... G06M 7/06

[52] U.S. Cl. ..... 250/223 R; 235/92 V; 235/92 SB; 235/98 C; 250/222 PC; 356/448

[58] Field of Search ..... 250/222 PC, 223 R, 562, 250/560, 563, 561, 214; 235/92 V, 98 C, 92 SB; 356/448

[56] References Cited

U.S. PATENT DOCUMENTS

| | | | |
|---|---|---|---|
| 2,908,825 | 10/1959 | Frankle et al. | 250/214 |
| 3,414,732 | 12/1968 | Stegenga | 250/223 R |
| 3,557,380 | 1/1971 | Matthews | 250/222 |
| 3,737,666 | 6/1973 | Dutro | 250/223 R |
| 3,885,872 | 5/1975 | Howe, Jr. et al. | 250/561 X |
| 4,027,155 | 5/1977 | Rappaport | 250/222 |
| 4,112,309 | 9/1978 | Nakazawa et al. | 250/560 |

*Primary Examiner*—David C. Nelms
*Assistant Examiner*—Edward P. Westin
*Attorney, Agent, or Firm*—Crandell & Polumbus

[57] ABSTRACT

An electro-optical device mounted over a conveyed stream of articles for sensing the passage of each article by projecting a single spot of light onto the articles and measuring the reflectance of that spot from two different angles. The measured reflectance values are fed to an electronic comparator which produces an output signal when one reflectance value exceeds the other by a predetermined amount.

12 Claims, 7 Drawing Figures

COUNTING SYSTEM FOR ARTICLES CONVEYED IN A STREAM

BACKGROUND OF THE INVENTION

This invention relates to apparatus for detecting the presence of or counting articles being conveyed in a stream. The invention has particular application to the graphic arts industry wherein printed articles such as newspapers, books, magazines and the like are conveyed from one operation to another.

Heretofore counters employed in the graphic arts industry have generally required a physical contact with the printed product, often requiring the stream to be confined between upper and lower conveyor bands. The contact may be a mechanical sensor engaged by the leading edge of the article, or a guide member for positively guiding the article past a photo-electric sensor. Irregularities in the product, such as newspapers, and the dynamics of the sensor and the article at high speed printing operations can lead to erroneous and inaccurate counting. Moreover, where high quality signatures are produced, physical contact with the surface of the article can damage the products.

The J. A. Stegenga U.S. Pat. No. 3,414,732 discloses a counter which does not require physical contact with the articles, and does not require a confined stream. A light source is projected onto the stream of products to illuminate the products for an electro-optical sensor. The latter registers the passage of an article by detecting the shadow, or change in illuminance created by the leading edge of the article. However, to reduce the possibility of the sensor reacting to a densely printed area on the product, a high intensity light source is required in conjunction with a relatively long, narrow slit in the sensor housing to sense a substantial area of the product. Additionally, a reflective plate is required to be mounted below the stream to maintain the normal illuminance when no product is present in the stream, whereas without the plate, a lessening of the illuminance would cause a count pulse to be generated. The Stegenga device also requires an air supply to maintain the long, narrow slit free of dust accumulation.

SUMMARY OF THE INVENTION

It is an object of this invention to provide an improved electro-optical sensing device which provides an electrical output pulse upon the passage of an article, said device operating with improved accuracy and at faster speeds than present devices.

It is a specific object of this invention to provide an electro-optical counter which may be positioned over a stream of articles, does not physically contact the articles, requires only a small area of the article for operation, is insensitive to printing density on the surface of the article and does not require additional cooperative elements to be mounted adjacent the stream of articles.

These and other objects will become more apparent in the following description when read in conjunction with the accompanying drawings.

DESCRIPTION OF THE PREFERRED EMBODIMENT

Figure 1:
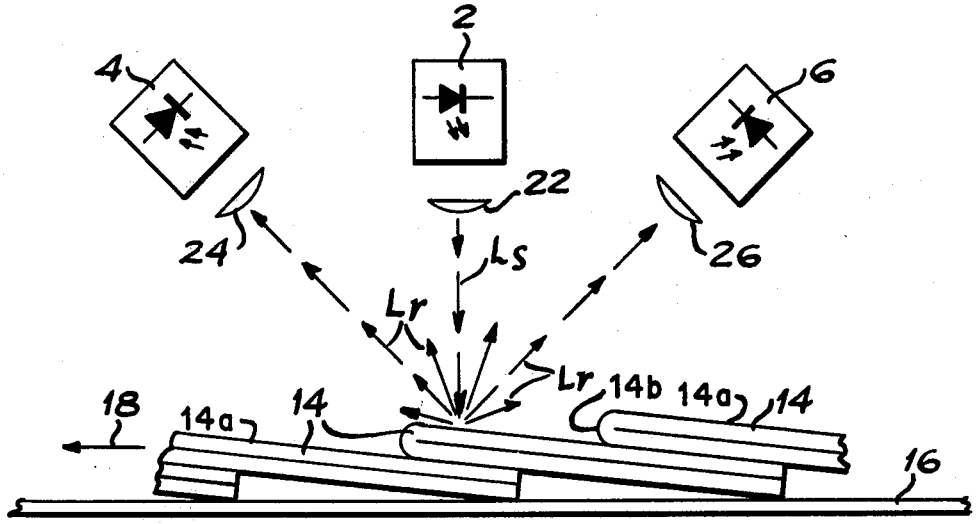
FIG. 1 is a schematic illustration of the electro-optical sensor of this invention in conjunction with a stream of printed articles in overlapped condition depicting one operating condition of the sensor.
Figure 2:
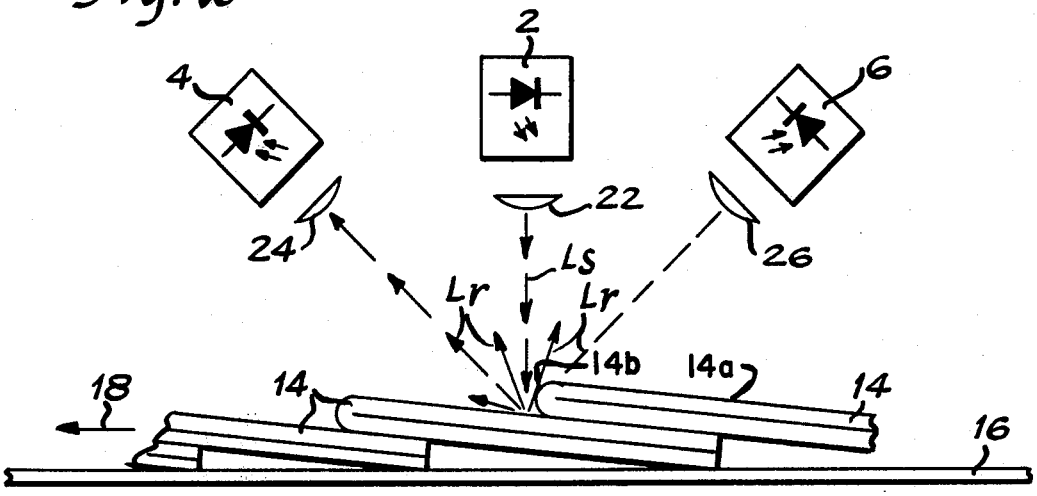
FIG. 2 is a schematic view similar to FIG. 1 but depicting a second operating condition.
Figure 3:
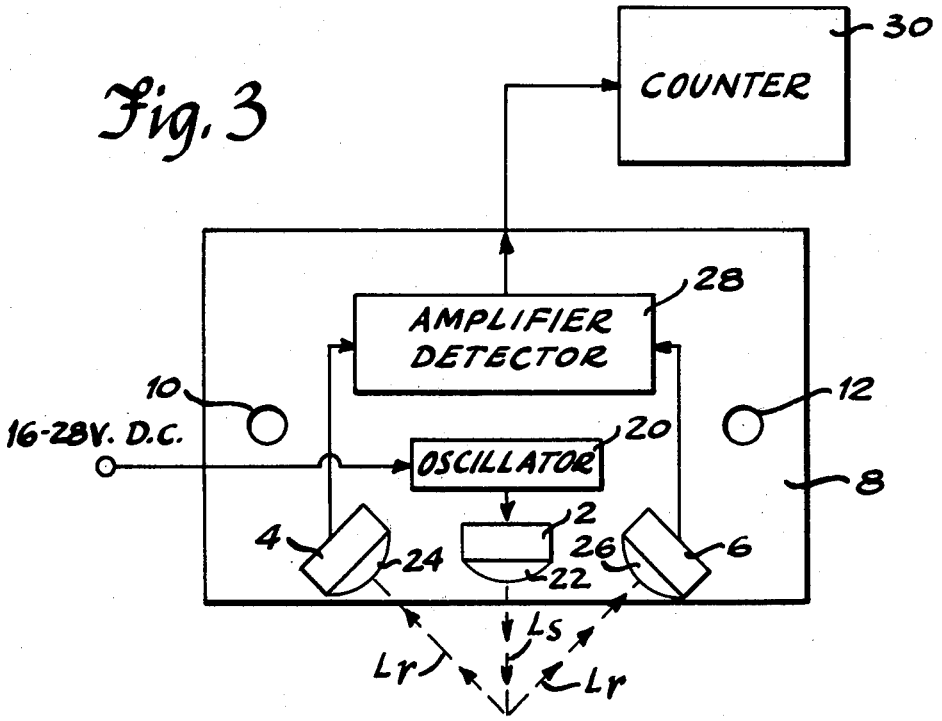
FIG. 3 is a schematic diagram of the electro-optical sensor of this invention embodied in a counting structure.

With reference to FIGS. 1–3, a light emitting diode 2 and two photo-diode transducers 4 and 6 are mounted within a housing 8 represented by a rectangular outline. The exact structure of housing 8 is not important to the invention herein except that it be provided with windows in its lower surface through which the light emitted by diode 2 may pass and be reflected back to diodes 4 and 6. Housing 8 is also provided with a pair of holes 10 and 12 for purposes of mounting the device in position above a stream of articles 14 such as newspapers or the like traveling on a conveyor 16 in the direction of arrow 18.

Light emitting diode 2 is a PN gallium arsenide device such as that manufactured by Spectronics Incorporated, Richardson, Tex. under part number SE-3455-3. A D.C. input of 16–28 volts is fed to an oscillator 20 which in turn provides a forward bias on diode 2 causing the latter to emit a near-infrared light represented as a single beam by the arrows Ls. The Ls is focused, sized and shaped through a lens 22 adjacent diode 2 to project a well defined spot on the surface 14*a* of one of the newspapers 14 immediately below diode 2. Light beam Ls is reflected from the newspaper surface in all directions as represented by the arrows Lr.

Photo-diode transducers 4 and 6 are preferably planar diffused silicon PIN devices such as that manufactured by United Detector Technology, Inc. of Santa Monica, Calif. under part number PIN-5D. Combined lens and filter assemblies 24 and 26 are provided for the diodes 4 and 6, respectively to receive the incident light Lr reflected from the surface of the newspaper and project it onto the respective photo-diode. The photo-diodes 4 and 6 produce electrical ouput signals proportionate to the amount of incident light energy received thereby. As will be seen in the drawings, photo-diodes 4 and 6 are positioned on either side of light emitting diode 2 and are directed toward the projected spot on the surface of newspaper 14 at equal, but opposite angles to the light beam Ls. Accordingly, in the condition depicted in FIG. 1, both photo-diodes 4 and 6 receive an equal amount of incident light Lr, and therefore the output signals of the photo-diodes are equal.

The output signals of photo-diodes 4 and 6 are fed into an amplifier-detector 28, which may be an operational amplifier or similar type of comparator. The amplifier-detector 28 compares the magnitude of each signal and produces an output pulse when the comparison detects a difference in magnitude between the signals being supplied thereto.

When the sensing device thus far described is used as a means for counting articles, the output of amplifier-detector 28 is connected to the input of a counter 30. The type of counter utilized will be a matter of choice according to the functions to be performed. For purposes of this described embodiment, it can be assumed that counter 30 has a count accumulation section which stores each individual output pulse from amplifier-detector 28 and has a set-count feature which produces an output signal from the counter upon each registration of a selected count total.

Figure 4A:
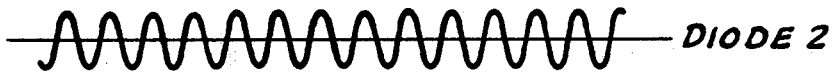
FIGS. 4*a–c* are graphic representations of the electrical waveforms of the various elements of the electro-optical sensor.

As seen in FIGS. 1 and 2, the newspapers are traveling in an overlapped stream on conveyor 16 in the direction of arrow 18, the leading edge of one newspaper 14 lying on top of the trailing edge of the preceeding paper. Light beam Ls from diode 2 is projected onto the top surface of a paper (FIG. 1) and is reflected equally toward photo-diodes 4 and 6. FIG. 4*a* illustrates the wave form representing the light energy level light beam Ls, which is a continuous wave of constant amplitude and a frequency of approximately 20K Hz.

As the newspaper moves to the left, the light spot of beam Ls is projected onto areas of varying reflective surface conditions such as texture, color and density which modulate the reflected light energy. Such modulations appear in the portion Tx of FIGS. 4*b* and 4*c* which illustrate the wave form representing the amplified incident light energy received from the photo-diodes 6 and 4, respectively, by amplifier-detector 28.

Figure 4B:
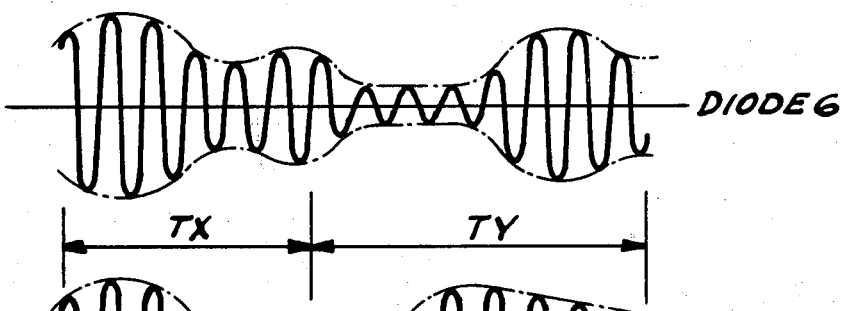
Figure 4C:
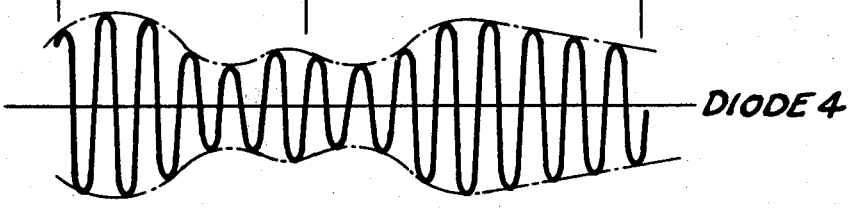

When the next succeeding newspaper 15 progresses to the point shown in FIG. 2, the leading edge 14*b* of that paper momentarily blocks the reflected light Lr from photo-diode 6, whereas photo-diode 4 receives the normal quantity of light. Moreover, another small increment of movement of the leading edge 14*b* of that paper will directly reflect the light beam Ls toward photo-diode 4. These conditions are depicted in the portions Ty of FIGS. 4*b* and 4*c*, wherein the amplitude of the wave in FIG. 4*b* is reduced while the amplitude of the corresponding section of the wave in FIG. 4*c* is increased. This difference in amplitude is detected by amplifier-detector 28 to produce an output pulse to counter 30. The overlap of the newspapers and the direction of travel of the stream are such that photo-diode 4 is never shadowed. This allows photo-diode 4 to meter the reflectivity of the surface of newspapers 14, and thereby to be used as a reference for comparison to photo-diode 6 within amplifier-detector 28.

The sensing mechanism as described herein will operate without providing a false count if a gap should appear in the stream of papers. Normally the conveyor 16 comprises a series of wire belts which, when no papers are present, provide only open space beneath the sensor. In this condition, the diode 2 projects the light beam Ls into open space and no reflected light occurs. Inasmuch as both photo-diodes 4 and 6 receive no reflected light, the outputs of both diodes will be equal and no output pulse will be produced by amplifier-detector 28. When the next succeeding paper moves into position under the diode 2, the light beam Ls will be first projected onto the rounded leading edge and momentarily will be fully reflected to photo-diode 4 while photo-diode 6 is completely shadowed. This produces a difference in amplitudes of the outputs of diodes 4 and 6, which is detected by amplifier-detector 28 to produce an output pulse of the latter. The same situation will exist if a solid belt conveyor 16 is used, for while the gap in the stream of newspapers exists, the light beam Ls will be projected on the surface of the belt and reflected equally to both photo-diodes 4 and 6.

It should be appreciated that while the sensor has been described herein in conjunction with a counter for counting newspapers or the like, it is capable of other applications as well. For instance, it may be used in printing or punch press operations to sense the presence of an article when it is in properly registered position by sensing the movement of the leading edge into position and thereby triggering an operation to be performed on the article. It may further be used to sense the presence of a second, trailing article moving into the registration area before the above mentioned operation is performed on the first article, and thereby produce a signal preventing the operation until the second article is removed.

Figure 5:
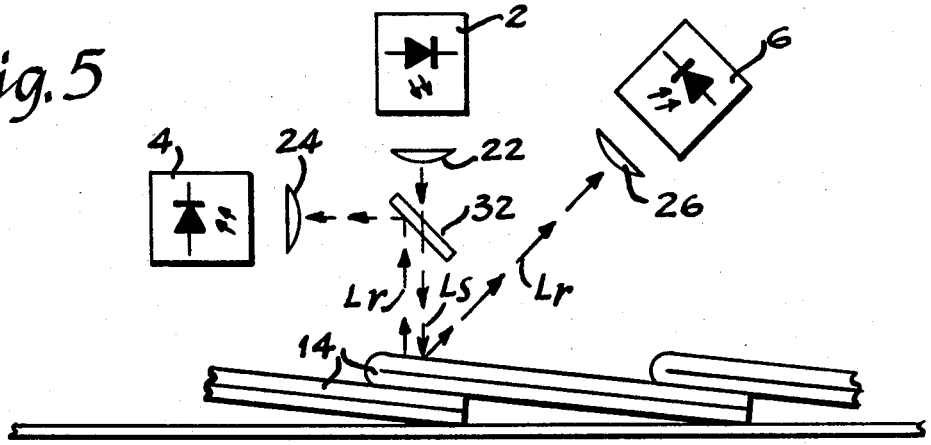
FIG. 5 is a view similar to FIG. 1, but showing a modified embodiment.

An alternative embodiment is shown in FIG. 5. In certain installations, a portion of conveyor supporting structure or the like may be in a position which would interfere with the incident light Lr if the respective photo-diodes were at the aforedescribed angle. As shown in FIG. 5, this situation may be remedied by employing a one-way, or half mirror 32. The mirror 32 is positioned below the diode 2 at an angle with the emitted light beam Ls such that the latter may pass through the mirror without distortion and be projected onto the surface of the newspaper 14. The opposite side of the mirror is fully reflective, and incident light Lr reflected straight back toward the source, or coaxially with light beam Ls, is reflected by mirror. The optimum angle of the mirror is 45° with the light beam Ls, which then reflects the coaxial incident light at right angles to the beam Ls. Downstream photo-diode 4 and its associated lens and filter assembly 24 are directed toward mirror 32 at a right angle with light beam Ls to receive the coaxial incident light reflected from the mirror.

While the sensor has been shown and described herein in a preferred embodiment, it should be understood that it is susceptible of various modifications without departing from the scope of the appended claims.

We claim:

1. An electro-optical sensing means for detecting articles moved therepast in a path, each of said articles defining a surface of characteristics which reflect light at all angles from incident light projected on the surface, each of said articles also having an edge or the like defining an abrupt step-like formation extending from the surface of said article, said electro-optical sensing means comprising, in combination:

light transmitting means emitting light toward said articles and projecting an incident spot of light on the surface of each article as each article moves past;

first and second light receiving means positioned respectively on the upstream and downstream sides of said spot of light and directed at predetermined angles toward the spot of light on the surface of each said article, the predetermined angles of direction of each said first and second light receiving means causing said light receiving means to each receive incident light from said light transmitting means reflected from the spot due to the reflective characteristics of the article surface, the predetermined angle of one said light receiving means further being determined in relation to the amount of extension of the step-like formation from the article surface in order to result in substantial blocking of the light reflected from the spot on the said one light receiving means by the step-like formation upon movement of said step-like formation into a predetermined position relative to said projected spot, said first and second light receiving means each producing an output signal of magnitude related to the amount of emitted light received by each respective light receiving means as reflection from the spot; and means for receiving the output signals from said light receiving means, and for comparing said output signals and for providing a detection signal when a characteristic of one of said output signals differs from a characteristic of the other of said output signals to indicate movement of the step-like formation into said predetermined position relative to said projected spot at which light characteristically reflected to said one light receiving means is substantially blocked.

2. The electro-optical sensing means of claim 1 wherein said light transmitting means emits near-infrared light.

3. The electro-optical sensing means of claims 1 or 2 wherein said light transmitting means includes means for focusing, sizing and shaping the emitted light into a beam which is projected upon the surface of said articles.

4. The electro-optical sensing means of claims 1 or 2 wherein said first and second light receiving means include means for filtering and focusing at least some of the light reflected from the spot on said first and second light receiving means.

5. The electro-optical sensing means of claims 1 or 2 wherein said light transmitting means is a solid state light emitting diode.

6. The electro-optical sensing means of claims 1 or 2 wherein said first and second light receiving means are solid state photo-diode transducers.

7. An electro-optical sensing means for detecting articles moved therepast in a path, each of said articles defining a surface of characteristics which reflect light at all angles from incident light projected on the surface, each of said articles also having an edge or the like defining an abrupt step-like formation extending from the surface of said article, said electro-optical sensing means comprising, in combination:

a light emitting source mounted above the path of movement of said articles and emitting light toward said articles and including means for focusing, sizing and shaping said emitted light into a beam which projects an incident spot of light on the surface of each one of said articles as the article moves past;

a first light receiving transducer mounted on the upstream side of said light emitting source and directed toward the light spot on the surface of said each one article at a predetermined angle relative to the beam;

a second light receiving transducer mounted on the downstream side of said light emitting source and directed toward the light spot on the surface of said each one article at a predetermined angle relative to the beam;

the predetermined angles of direction of each said first and second light receiving transducers causing each light receiving transducer to receive incident light from said light emitting source reflected from the spot due to the reflective characteristics of the article surface, the predetermined angle of one of said light receiving transducer further being determined in relation to the amount of extension of the step-like formation from each article surface in order to result in substantial blocking of the light reflected from the spot to the said one light receiving transducer upon movement of said step-like formation into a predetermined position relative to said projected spot;

said first and second light receiving transducers each producing output signals of magnitude related to the amount of emitted light received thereby as reflection from the spot; and means for receiving said output signals, comparing the characteristics thereof, and for producing a detection signal when the characteristic of one output signal differs from the characteristic of the other output signal to indicate movement of the step-like formation into the predetermined position relative to said projected spot at which light characteristically reflected to said one light receiving transducer is substantially blocked.

8. The electro-optical sensing means of claim 7 wherein said light emitting source is a solid state light emitting diode.

9. The electro-optical sensing means of claim 7 wherein said first and second light receiving transducers are solid state photo-diodes.

10. An electro-optical sensing means for detecting articles moved therepast in a path, each of said articles defining a surface of characteristics which reflect light at all angles from incident light projected on the surface, each of said articles also having an edge or the like defining an abrupt step-like formation extending from the surface of said article, said electro-optical sensing means comprising in combination:

a light emitting source mounted above the path of movement of said articles;

means for focusing, sizing and shaping the emitted light to project a well defined beam of light as a spot onto the surface of each one of said articles as the article moves past;

one-way mirror means mounted in the path of said beam of light at an angle to the beam to permit said beam to be projected therethrough onto each said article and to reflect light reflected from the spot coaxial with said beam at an angle to said beam;

a first light receiving transducer mounted on the upstream side of the projected spot of light and directed at a predetermined angle toward the spot of light on the surface of said each one article, the predetermined angle of direction of said first light receiving transducer causing said first light receiving transducer to receive light reflected from the spot due to the reflective characteristics of the article surface and further being determined in relation to the amount of extension of the step like formation from each article surface in order to result in substantial blocking of the light reflected from the spot to said first light receiving transducer upon movement of said step-like formation into a predetermined position relative to said projected spot;

a second light receiving transducer operatively directed toward said mirror means to receive light reflected by said mirror means from the projected spot;

said first and second light receiving transducers each producing output signals of magnitudes related to the amount of emitted light received thereby as reflection from the spot; and means for receiving said output signals, and for comparing the characteristics thereof and for producing a detection signal when the characteristic of the output signal from said second light receiving transducer differs from the characteristic of the output signal from said first light receiving transducer to indicate movement of the step-like formation into the predetermined position relative to said projected spot at which light characteristically reflected to said first light receiving transducer is substantially blocked.

11. An invention as recited in claims 1, 2, 7 or 10 wherein said articles are newspapers upon which the surfaces thereof also have areas of varying reflective surface conditions.

12. An electro-optical sensing means for detecting the passage of individual newspapers moved therepast in a path, each of said newspapers defining a surface of characteristics which reflect light at all angles from incident light projected on the surface, each of the newspaper surfaces aslo defining various areas of varying reflective surface conditions which substantially vary the quantity of light reflected from the surface, each of the newspapers also having an edge extending abruptly from the surface, the newspapers in the stream normally being lapped on top of one another with the edge of one newspaper extending abruptly above the surface of an adjacent lapped newspaper in the stream; said electro-optical sensing means comprising, in combination;

light emitting means stationarily mounted above the path of movement of said newspapers for emitting a beam of light which projects an incident spot of light on the surface of each of said newspapers as the newspaper moves beneath said light emitting means;

first light receiving means stationarily mounted above the path of movement of said newspapers for receiving light reflected from the spot at a predetermined angle generally upstream relative to the movement path;

second light receiving means stationarily mounted above the movement path of said newspapers for receiving light reflected from the spot at a predetermined angle generally downstream relative to the movement path;

the predetermined angles at which said first and second light receiving means receive light from the spot being determined such that each light receiving means normally receives emitted light reflected from the spot due to the reflective characteristics of the newspaper surface, the predetermined angle at which one of said light receiving means receives light is further determined in relation to the amount of extension of the edge of the newspaper above the surface of an adjacent lapped newspaper to result in substantial blocking of the light reflected from the spot to the said one light receiving means upon movement of the edge of the newspaper into a predetermined position relative to the projected light spot;

said first and second light receiving means each producing output signals of magnitude related to the amount of emitted light received thereby as reflection from the spot; and comparing means, operatively connected to receive the output signals from said first and second light receiving means, for comparing the respective characteristics of the output signals from said first and second light receiving means and for producing a detection signal upon the characteristic of one of the output signals differing from the characteristic of the other output signal to indicate substantial blocking of the light reflected from the spot to the one said light receiving means.

* * * * *